United States Patent [19]

Hagemeister

[11] Patent Number: 4,815,535

[45] Date of Patent: Mar. 28, 1989

[54] HEAT EXCHANGER

[75] Inventor: Klaus Hagemeister, Munich, Fed. Rep. of Germany

[73] Assignee: MTU Motoren-Und Turbinen -Union Munchen GmbH, Munich, Fed. Rep. of Germany

[21] Appl. No.: 105,874

[22] Filed: Oct. 7, 1987

[30] Foreign Application Priority Data

Oct. 29, 1986 [DE] Fed. Rep. of Germany ..... 3636762

[51] Int. Cl.[4] ..... F28F 9/02

[52] U.S. Cl. ..... 165/173; 165/163

[58] Field of Search ..... 165/163, 173; 29/176, 29/157.4

[56] References Cited

U.S. PATENT DOCUMENTS

| | | | |
|---|---|---|---|
| 1,293,868 | 2/1919 | Murray | 29/157.4 |
| 1,420,241 | 6/1922 | Cain | 29/157.4 |
| 3,885,936 | 5/1975 | Limebeer | 165/172 X |
| 4,206,806 | 6/1980 | Toyashi | 165/175 X |
| 4,597,436 | 7/1986 | Hagemeister | 165/76 |
| 4,632,182 | 12/1986 | Hagemeister | 165/176 |

*Primary Examiner*—Ira S. Lazarus
*Assistant Examiner*—Peggy Neils
*Attorney, Agent, or Firm*—Roberts, Spiecens & Cohen

[57] ABSTRACT

A heat exchanger having a matrix of tubes around which hot gases flow, the matrix comprising spaced internested oval profiled tubes connected to a manifold for supply of compressed air to the tubes. The manifold is composed of a plurality of superimposed elements assembled on another in fluid-tight fashion. The profiled tubes have rectangular or square base ends which are fitted into corresponding openings in the superimposed elements.

19 Claims, 8 Drawing Sheets

HEAT EXCHANGER

FIELD OF THE INVENTION

The invention relates to a heat exchanger of the type comprising an assembly of a plurality of heat exchanger tubes for conveying a first fluid therethrough which can undergo heat exchange with a second fluid flowing around the exterior of the tubes, the tubes having oval cross-sections and being arranged in spaced relation in rows and columns in which the tubes are staggered to internest with one another. A distributor is connected to the tube assembly for supply of the first fluid to the tubes and for receiving the first fluid therefrom after the first fluid has undergone heat exchange with said second fluid.

DESCRIPTION OF THE PRIOR ART

It is known, for example, from DE-PS No. 2907810 to produce heat exchangers with central manifolds or ducts which receive heat exchange tubes of oval cross-section by insertion of the tubes into openings in a wall of the duct after which the tubes are secured and sealed to the duct by soldering or welding so that a fluid passage is obtained between the duct and the inside of the tubes.

The openings in the wall of the duct can be formed by drilling or erosion, which is an expensive hole-making procedure. The individual mounting of the tubes, especially their insertion into the openings is comparatively cumbersome, as only a narrow clearance which provides a displaceable snug fit is present between the profiled tube and the opening in the wall. Close tolerances between the opening and the profiled tube must be maintained in order to provide dependable soldering or welding to form a sealed joint.

In an endeavor to obtain a relatively simple, problem-free rapid mounting of the provided tubes on the duct or manifold, DE-OS No. 32 42 842 discloses blocks surrounding the profiled tube ends, the tubes being arranged tightly adjacent each other in the region of their blocks so that the blocks form a wall of the duct or manifold. The connection joints of the blocks are sealed in fluid-tight manner.

In this construction, the blocks are applied by metal sintering onto the profiled tubes by arranging powdered sintering material in a shape which is substantially similar to the desired shape of the block around the corresponding profiled tube end and the powder is sintered in gas-tight manner. The outer contact surfaces of the blocks can be machined to accurate dimensions before mounting the profiled tubes. The machining can be cold forging, embossing or grinding operations.

The blocks can be rhombic, hexagonal or honeycomb in shape.

This construction requires a comparatively complicated and highly precise production of the base of the profiled tube. Furthermore, the entire connection region of the tubes of the matrix must be assembled in relatively complicated manner from a relatively large number of blocks which are extremely precisely fitted to one another. Such a structure formed of very small parts which are joined together is disadvantageous from the viewpoint of structural strength.

In other known heat exchanger, U.S Pat. Nos. 4,597,436 and 4,698,888, the profiled tubes of the matrix, which have an elongated oval cross section are firmly secured in fluid-tight manner in openings formed in adjacent annular layers which make up the wall of the duct or manifold. The annular wall elements have, in each case at their joint surfaces, semi-elliptical cutouts which are aligned for receiving the elongated oval tube end. This construction also requires extremely accurate machining of the corresponding wall elements. Despite very precise machining, differences in shape and manufacturing tolerances exist in practice, particularly in the regions of the front and rear ends on the connection side. Therefore locally different end compression can result in the tube ends, for example, when the wall elements are superimposed on the profiled tubes, whereby the sealing operation, for example, by soldering or welding between the profiled tube ends and the wall elements can be impaired due to local solder displacements or lack of homogeneous soldering. Furthermore, notch-effect weakness can exist in view of the fact that the profiled tubes are sealed at relatively slender pointed ends in the wall elements.

Furthermore, in the conventional arrangements, the matrix of the profiled tubes forms correspondingly arranged fields of the oval or elliptical cutouts between the wall elements. In this regard, the matrix of the tubes is formed by an array of the tubes in rows and columns which are staggered and offset to be internested to maximize the flow of the fluid therearound and its heat exchange with the fluid flowing in the tubes. Thus, the corresponding openings in the manifold weaken the strength of the manifold in the region of its connection with the tubes of the matrix. This applies by analogy also to the heat exchanger construction in DE-PS No. 29 07 810.

SUMMARY OF THE INVENTION

An object of the present invention is to provide a construction of a heat exchanger in which the known disadvantages set forth above are eliminated. A further object of the invention is to provide a heat exchanger in which the duct or manifold can be constructed at relatively low expense while having optimal strength and establishing excellent conditions for connection of the tubes of the matrix in fluid-tight manner.

The above and further objects of the invention are obtained according to the invention by forming the base ends of the heat exchange tubes of the matrix with a polygonal cross-section, particularly square or rectangular.

In further accordance with the invention, the base ends of the tubes of the matrix are formed in square or rectangular shape into the manifold or duct. This can be effected, for example, in a swaging machine, in which internal mandrels can be used, depending on the degree of reshaping. As a result of the rectangular or square shaping of the base ends of the profiled tubes, the structural elements can be engaged with each other upon assembly and fixed in a predetermined position. In this respect, rectangular or square openings can be provided in the corresponding duct or in wall elements forming the same so as to receive the corresponding base ends of the tubes firmly and in form-locked manner therein. As a result of the formation of the base ends of the tubes with linear smooth side walls, the base ends can be built-up to form a layer which can be easily covered on one side in form-locked manner by flush strip-shaped connecting elements, which also extend linearly.

As an alternative, it is also possible, in accordance with the invention, not to provide any individual openings in the duct for the base ends of the profiled tubes. In this regard, the duct can be provided with circumferential slits into which the base ends of the tubes can be pushed from the outside in rows one above the other, for example, individually in sequence one after the other.

The construction according to the invention furthermore provides substantial advantages with respect to a so-called "modular" building concept in that it is possible, in comparatively simple manner, to establish preassembled individual assemblies of the duct and matrix.

Individual modules can, for example, easily be obtained in accordance with the invention by preassembling the ends of profiled tubes along their narrow end sides, for instance by welding or soldering, which then could be inserted into correspondingly prepared openings in the duct or be integrally connected therewith.

DETAILED DESCRIPTION OF PREFERRED EMBODIMENTS

Figure 1:
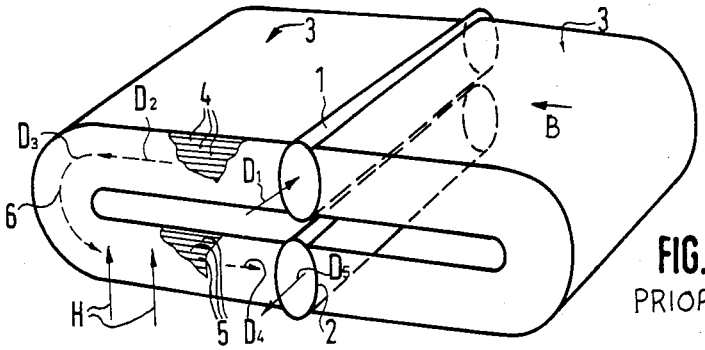
FIG. 1 PRIOR ART
FIG. 1 diagrammatically illustrates in perspective, partly broken away, a conventional heat exchanger.

Referring to FIG. 1, therein is seen a conventional heat exchanger which comprises an assembly or matrix 3 of heat exchange tubes of U-shape which are positioned in a housing or casing (not shown) such that heated gases H can flow over the tube matrix 3 in the direction of the arrows.

The U-shaped tubes of the matrix 3 have straight legs 4 connected to an inlet duct 1 and straight legs 5 connected to an outlet duct 2. The ducts 1 and 2 extend substantially parallel to one another in a direction perpendicular to the flow of hot gases H. The tubes of the matrix extend in equally spaced parallel relation in the matrix along the length of ducts 1 and 2 and the tubes project transversely of the ducts into the path of flow of gases H.

A fluid, such as compressed air, is supplied to the duct 1 as shown at $D_1$ and the fluid flows from duct 1 into the straight legs 4 of the heat exchanger tubes along path $D_2$. The compressed air undergoes reversal of direction along path $D_3$ in a curved bend region 6 of the U-shaped tubes whereafter the compressed air flows in straight legs 5 of the heat exchanger tubes along paths $D_4$ into duct 2 from which the compressed air is discharged at $D_5$. The ducts 1 and 2 are closed at their rear ends as shown by the hatching thereat.

In its path of travel through the tubes of the matrix, the compressed air is heated by the gases H flowing around the exterior of the tubes so that the compressed air discharged from duct 2 is heated. The heated compressed air discharged from duct 2 can be supplied to a suitable consuming means, such as the combustion chamber of a gas turbine power plant.

Figure 2:
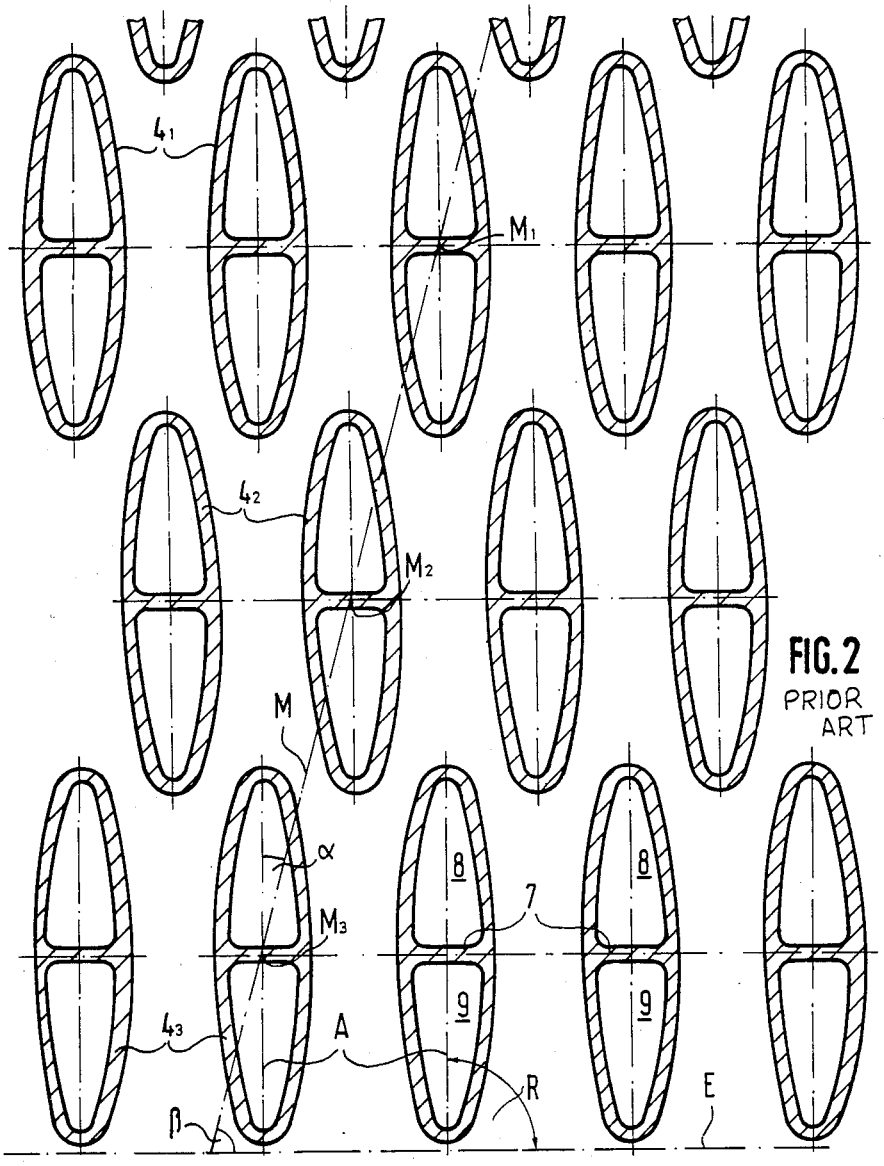
FIG. 2 PRIOR ART
FIG. 2 shows, in section, portion of a matrix of profiled tubes in the direction B in FIG. 1.

FIG. 2 shows the traditional arrangement of the heat exchange tubes of the matrix 3 on greatly enlarged scale through the straight leg portions 4 in FIG. 1. In FIG. 2 are seen, by way of example, three rows of tubes extending in the longitudinal direction of the duct 1 and designated $4_1$, $4_2$ and $4_3$ one after the other, from top to bottom. In the longitudinal and transverse directions of the duct 1 the tubes $4_1$, $4_2$, $4_3$ are arranged at uniform spacing from each other. As seen in FIG. 2, the tubes are offset and staggered in rows and columns to produce an internested relation of the tubes which provides a very compact field for the tubes of the matrix. For instance, the upper and lower ends of tubes $4_2$ extend into the transverse spaces between the ends of adjacent tubes $4_1$,$4_3$. The compact field of the heat exchange tubes is characteristic of heat exchangers in accordance with FIG. 1 The arrangement of the tubes in the field in FIG. 2 could, for example, also be defined by oblique planes M arranged at the same angle of inclination o with respect to the corresponding longitudinal axes A of the profiled tubes (or the longitudinal center planes of the profiled tubes). The planes M pass through the centers of the profiled tubes as shown at M1, M2 and M3. The longitudinal axes A of the profiled tubes $4_1$, $4_2$ and $4_3$ in FIG. 2 are at right angles R to the transverse central plane E of duct 1. The angle of inclination $\beta$ of the oblique planes M with respect to plane E is equal to R-$\alpha$.

As can furthermore be seen in FIG. 2, the profiled tubes $4_1$, $4_2$ and $4_3$ are of elongated oval cross-section so as to be aerodynamically optimized and each tube has two inner channels 8, 9 which are separated from each other by a central transverse web 7, for the flow of compressed air along path $D_2$ (FIG. 1).

Figures 3, 7:
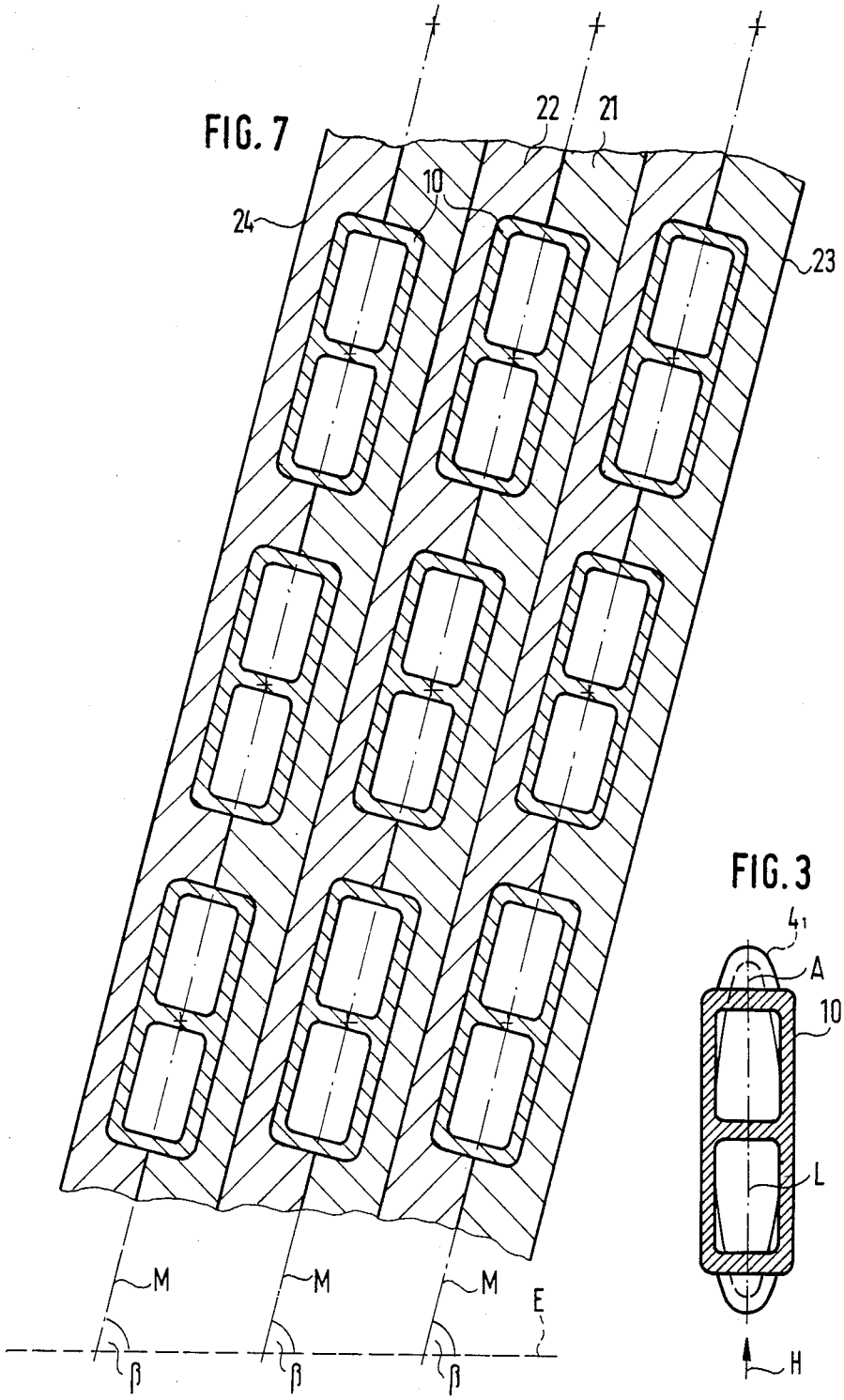
FIG. 3 is a sectional view through a rectangularly shaped base end of a heat exchanger tube, according to the invention seen from the inner side of the tube.
FIG. 7 is an elevational view, broken away and in section of another embodiment of the duct or manifold for use in combination with the heat exchanger tube of FIG. 5.
Figure 4:
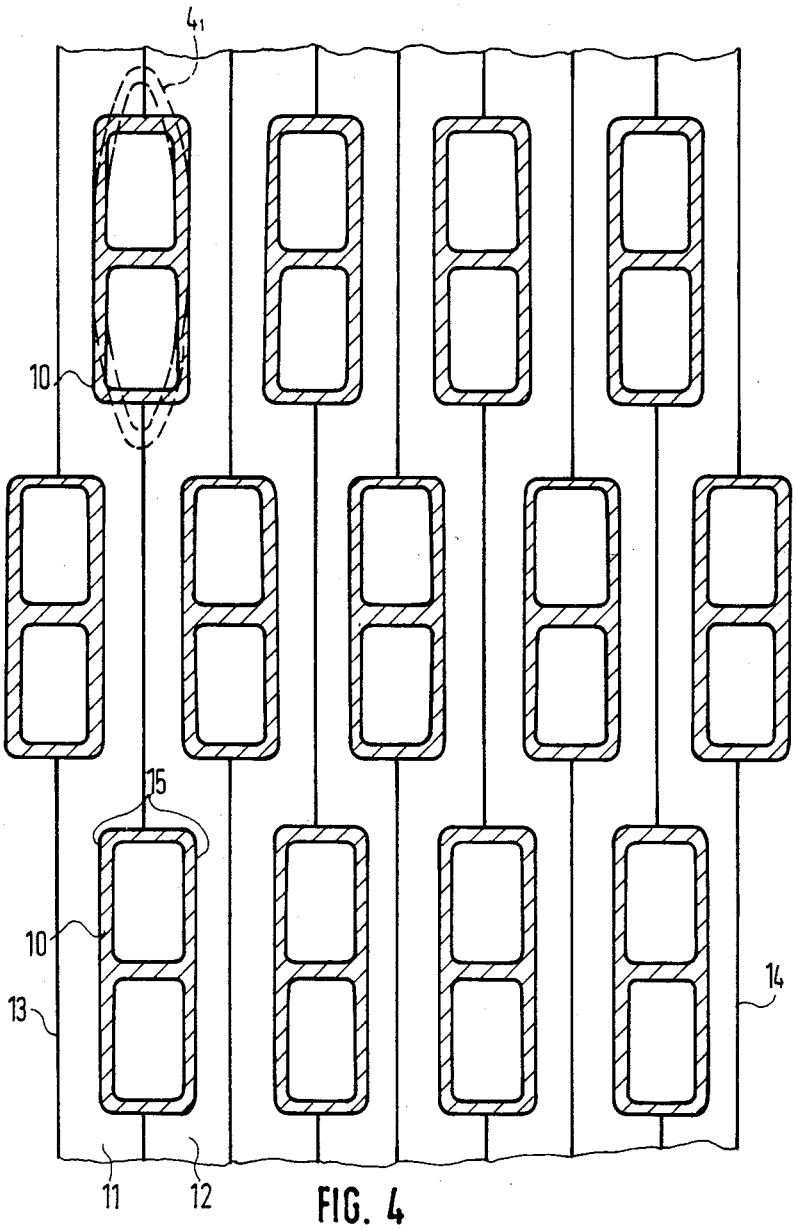
FIG. 4 is an elevational view of a portion of a duct or manifold of the heat exchanger in which rectangular base ends of the heat exchanger tubes have been inserted and shown in section.

In accordance with FIG. 3 and FIG. 4, each profiled tube, for instance tube $4_1$, is provided with a base end 10 which is rectangular and has a symmetrical profile. The base end 10 has a longitudinal central plane L which lies in the plane of the longitudinal axis A (FIG. 2).

FIG. 4 shows an embodiment of the invention in which duct or manifold 1 or 2 is composed of superimposed layers of elements of which two are designated at 11 and 12. The layers 11 and 12 have linear abutting surfaces 13, 14 in which recesses 15 are formed to receive the base ends of the tubes. The recesses 15 have a rectangular shape adapted to receive the base ends 10 of the tubes of the matrix.

From FIGS. 3 an d 4 it can furthermore be noted that the portion of the profiled tube, for instance tube 4:, which is traversed by the hot gases H, projects at its ends beyond the corresponding edges of the rectangular base ends 10 as evident from the dotted outline in FIG. 4.

The base end 10 and the profiled heat exchanger tube 4 form a self-contained structural unit in which fluid communication is established. Because the base end 10 of the heat exchange tube has a shorter transverse width, relatively large spacing of the recesses 15 can be made in the abutting surfaces 13, 14 while preserving the compact field of the heat exchange tubes in the matrix as shown in FIG. 2.

Figure 6:
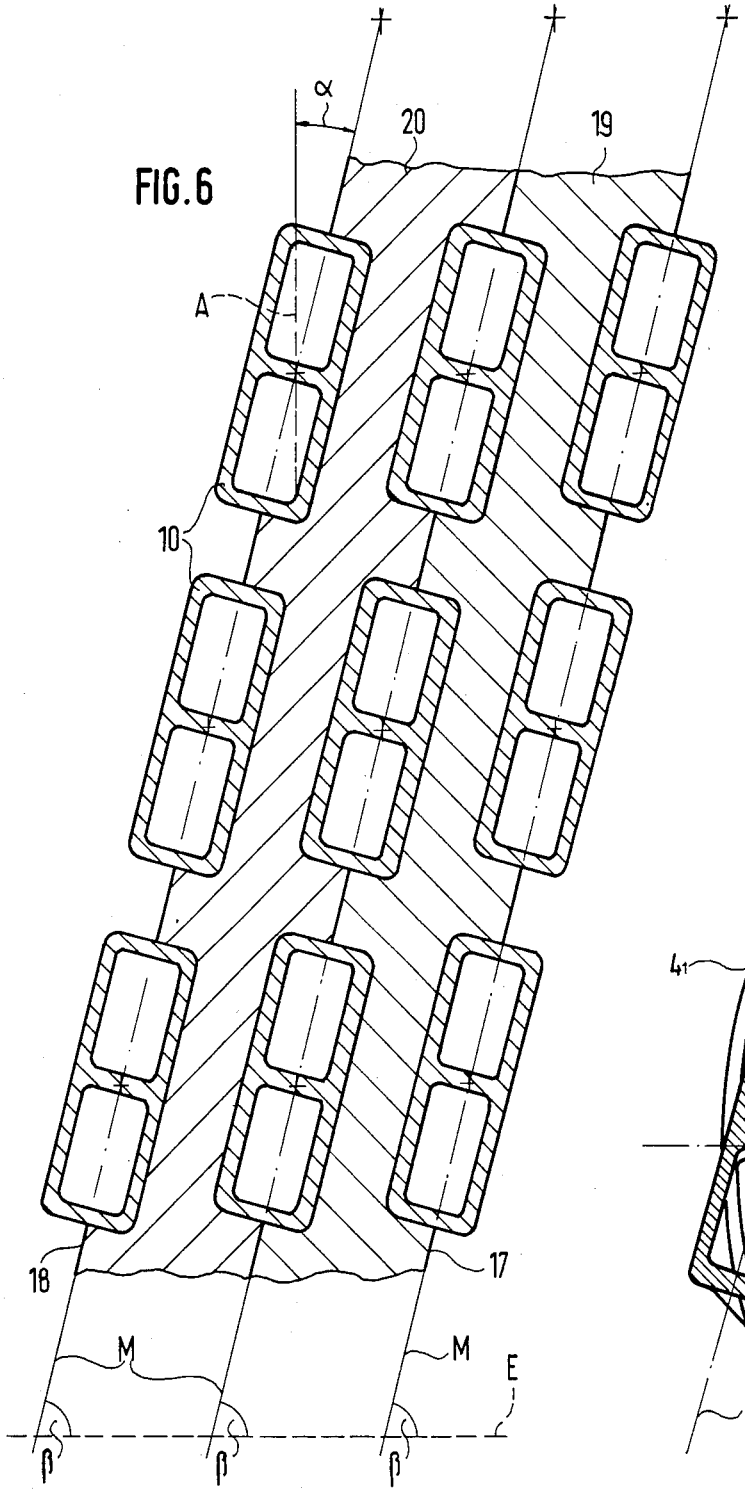
FIG. 6 is an elevational view, broken away and in section of another embodiment of the duct or manifold for use in combination with the heat exchanger tube of FIG. 5.
Figure 5:
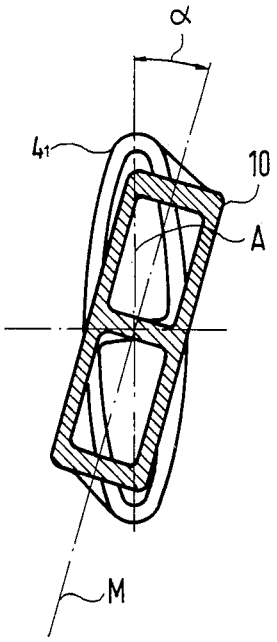
FIG. 5 is a sectional view through the base end of a heat exchanger tube in which the base end is substantially concentrically twisted with respect to the remainder of the tube.

FIGS. 5 and 6 show a variant of the invention in which the corresponding base end 10 is concentrically twisted about the center of the profile of the oval heat exchange tube by an angle $\alpha$ with respect to the long axis A of the profiled tube $4_1$ around which the hot gases flow. In accordance with FIG. 5, the amount of the twist can be such that the long axis A (which extends along the longitudinal central plane of the tube) intersects the corresponding base end 10 along the diagonal thereof. In FIG. 6, therefore, the corresponding base ends 10 extend with their longitudinal center planes along oblique division planes M (already defined in detail in FIG. 2) so that the corresponding profiled tubes (for instance $4_1$) which are twisted relative thereto by the corresponding angle $\alpha$ (see FIG. 5) are arranged with their long axes A at right angles R (FIG. 2) to the transverse central plane E of the duct or manifold. In accordance with FIG. 6, therefore, the corresponding abutment surfaces 17, 18 of the elements 19, 20 also extend along oblique planes M. Upon comparison with FIG. 4 it is evident that in FIG. 6 the number of required elements 19, 20, which are of ring shape, is half as great, so that each element 19 or 20 is comparatively firm and stable, which in turn has a favorable effect on the overall strength of the duct or manifold. To the same extent, the number of necessary abutment surfaces decreases.

The embodiment according to FIG. 5 makes it possible to divide a duct or manifold in different ways into a number of sections parallel to the division planes M, for instance into ring-shaped elements. A further variant of the invention with reference hereto can be seen in FIG. 7.

In FIG. 7 every two elements 21, 22 are so developed that their corresponding rectangular recesses engage in pincer-like fashion—on the inside—the rectangular base ends 10 along the mutual abutment surfaces which lie on the oblique division planes M. Along the outer surfaces 23, 24 which extend parallel to the division planes M, the elements 21, 22 have a smooth wall without recesses. In this respect, every two elements 21, 22 can advantageously form independent assembly units which can be equipped individually with the corresponding base ends 10 of the corresponding profiled tubes. To be sure there are more element divisions in FIG. 7 than there are in FIG. 6, but there are uninterrupted outer abutment surfaces 23, 24 in FIG. 7 which improves its manufacture.

For example, referring to FIG. 7 it is possible to place two ring-shaped elements 21, 22 around the base ends 10 of the heat exchanger tubes and by application of pressure along the outer edges of the elements 21, 22 and simultaneous supply of heat (for instance, by electric resistance heating) an integral connection can be produced.

The operating steps of associating the parts, bringing them together and attaching them to each other as well as the following quality control can be carrie d out substantially automatically. There is thus produced as intermediate assembly from which, by the addition of the required number of identical assemblies, a complete heat exchanger sheet or heat exchanger can be assembled, the abutment surfaces or seams of the completely preassembled assemblies lying on plane surfaces and their edges representing simple shapes, for instance circles or ellipses. The integral connection of the elements can be planar, for instance, by soldering or, along the mutual edges of the elements, by laser or EB welding.

Figure 8:
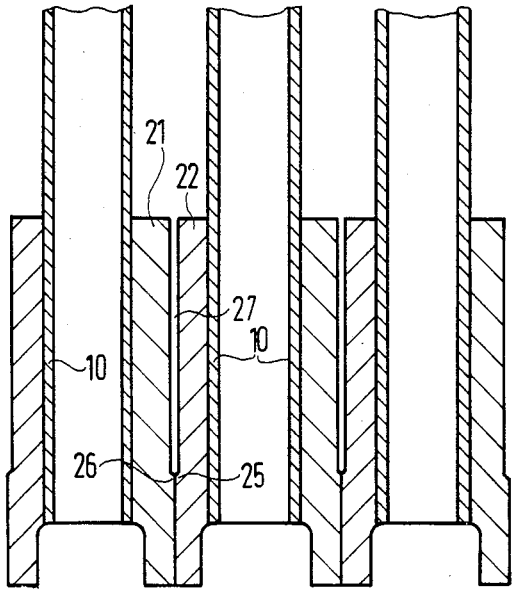
FIG. 8 is a longitudinal section through a duct or manifold, taken transversely in FIG. 7 showing one embodiment of attachment of the base ends of the heat exchanger tubes in the duct or manifold.

For this purpose, it may be advantageous, as shown in FIG. 8, to provide lip-like projections 25, 26 on the elements at the seam surfaces, preferably at the base end of these elements. Above the lip-like projections 25, 26, upwardly open seams 27 remain between the elements 21, 22. The welding can then be effected along the lip-like projections 25, 26. The projections 25, 26 can be machined away for possible repair purposes later on in order to open the connection at this location.

Figure 9:
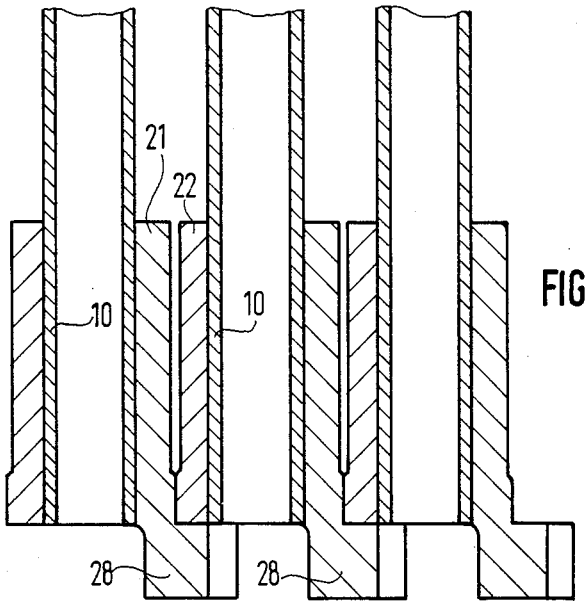
FIG. 9 is a view similar to FIG. 8 showing a second embodiment of attachment of the heat exchanger tubes to the duct or manifold.

FIG. 9 shows a modification of FIG. 8 in which in each case two adjacent elements 21, 22 are placed together and centered by means of ribs 28 on one element which engage below the other element inside the duct or manifold.

Figure 10:
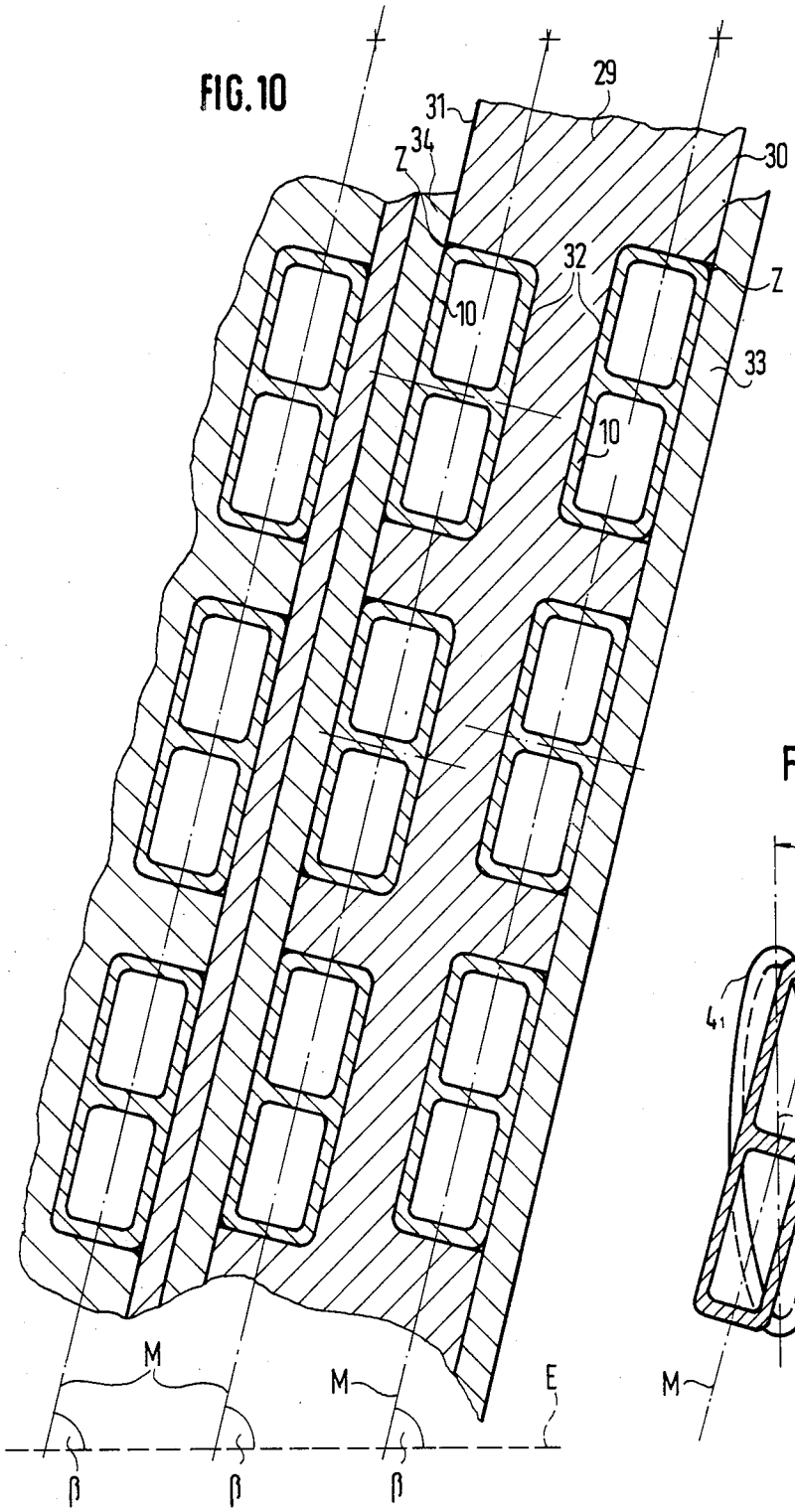
FIG. 10 is a view similar to FIG. 6 showing another embodiment of the duct or manifold for use in combination with the heat exchanger tube of FIG. 5.

Another embodiment of the invention is shown in FIG. 10 in which each element 29 is formed along both side surfaces 30, 31 with outwardly open rectangular recesses or cutouts 32 for receiving the corresponding base ends 10. The side surface 30, 31 are covered by respective strip-shaped connecting elements 33 and 34. The element 29, the connecting elements 33, 34 and the base ends 10 together with the corresponding profiled tubes are capable of forming an independent assembly unit.

Each assembly unit can then be joined to a corresponding unit to form an integral homogeneous surface. For connecting the completely premounted assembled units together as well as for the connecting of the individual parts of each independent assembly unit, soldering, welding or diffusion attachment can be effected. A space Z formed by a chamfer on the base end 10 can be filled by additional material when soldering or welding.

Figure 11:
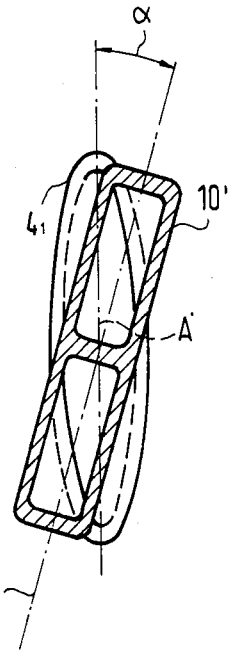
FIG. 11 is a view similar to FIG. 5 of a heat exchanger tube whose base end is narrower and longer.

Based on the same tube shape and size, FIG. 11 differs from FIG. 5 primarily by the fact that the corresponding base end $10^1$ is made narrower and longer. Otherwise, the same geometrical factors and nomenclature apply as in FIG. 5. With reference to a duct or manifold section according to FIG. 12 it can be noted that the longitudinal center lines of the base ends $10^1$ which extend along oblique division planes M have in each case a length L which corresponds to the center-to-center spacing Ma of the tubes in the corresponding partition planes M. In accordance with FIG. 12, an arrangement results in which the connection region at the duct or manifold consists of an alternating sequence of rectangular base ends 10' aligned with their narrow ends directly against each other and strip-shaped elements 35, 36 which cover the corresponding longitudinal sides thereof. The elements 35, 36 form smooth-walled seam surfaces with respect to each other as well as with respect to the adjoining longitudinal sides of the base ends 10', which surfaces in turn extend parallel to the oblique partition planes M.

Figure 12:
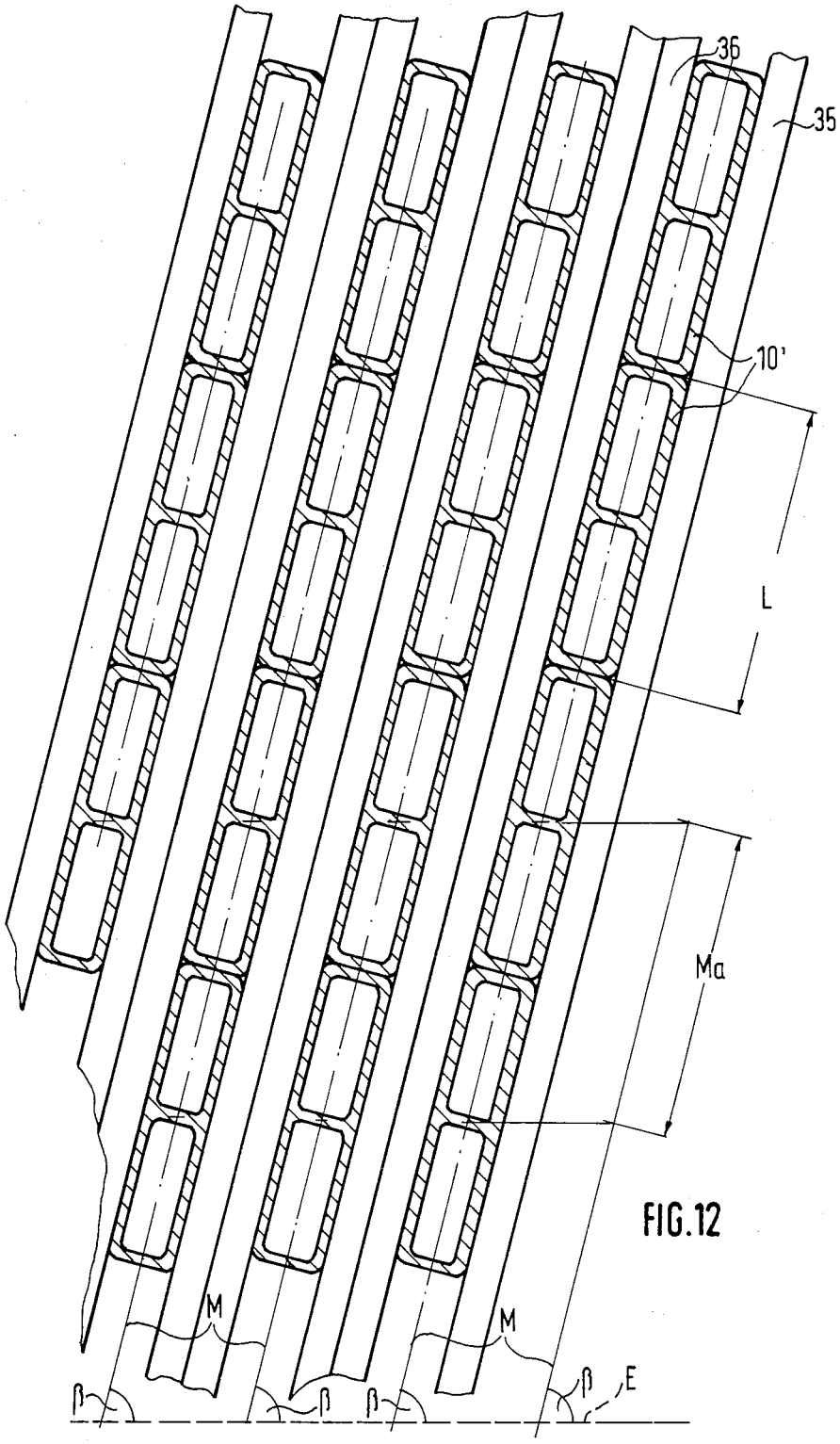
FIG. 12 is an elevational view of a portion of another embodiment of a duct or manifold in which the base ends of heat exchanger tubes of FIG. 11 are engaged and shown in section.

In accordance with FIG. 12, in each case two elements 35, 36 together with base ends 10' anchored alongside of them there in with the corresponding heat exchange tubes, for instance $4_1$ in FIG. 11, can form independent preassembled structural units which, in the manner already described, are assembled or integrally connected together in building-block manner to corresponding building units.

Figure 13:
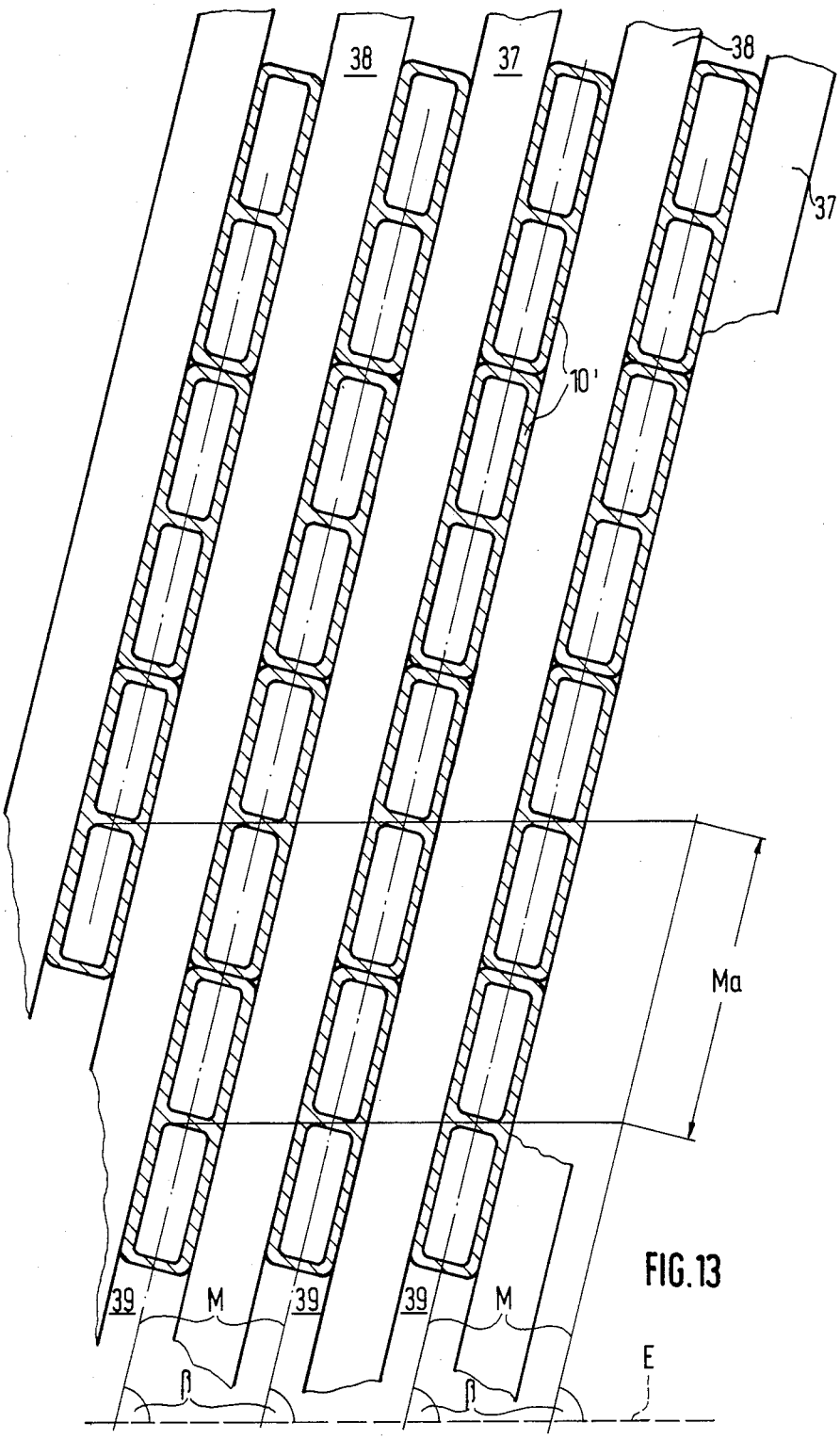
FIG. 13 is similar to FIG. 12 and shows another embodiment of a duct or manifold in combination with the heat exchanger tubes of FIG. 11.

FIG. 13 shows a variant of the duct or manifold in FIG. 12 in which the elements 37, 38 are fixed components of the duct or manifold and define parallel cutouts or slits 39 for receiving the base ends 10' of the heat exchange tubes 4, in stacked relation with their narrow end surfaces one above the other. In FIG. 13 it is also seen that the longitudinal center lines of the base ends 10' extend along the oblique division planes M, so that the end or seam surfaces adjoining the longitudinal sides of the base ends 10' in turn extend parallel to the division planes M. The base ends 10' together with the profiled tubes 4 can be pushed individually into the slits 39 and, after reaching an end operating position, integrally secured in fluid-tight manner, for instance by soldering, in the slits 39.

It is particularly advantageous initially to position the curved bend regions of the tubes together with the base ends of an assembly unit in a jig and to connect the contacting narrow sides of the rectangular base ends integrally to each other, for instance by welding or soldering. The profiled tube groups thus produced can be further subjected to a calibration in which the common width of the base profiles is precisely adapted to the slit width of the central duct by pressing, grinding or the like. These profiled tube construction groups are then introduced by their combined bases into the slit 39 of the central duct and attached firmly and tightly to the central duct by an integrating process such as soldering or welding. The individual operating steps of this assembly sequence can be automated and are thus suitable for streamlined mass production.

The mounting of the profiled base ends in the central duct is facilitated in that the ridge-like webs of the slit field in the central duct—particularly in the zenith—can be shifted somewhat resiliently in a transverse direction.

As a further aid in assembly, a vibration excitation of the central duct and the tube assembly group can be effected. A displacement in position of an assembly robot can in this connection be neglected by the kinetic lack of definition in position of the flange which are to be joined. The oscillation excitation furthermore reduces the frictional reactions when the structural parts are pushed into each other.

It may furthermore be advantageous to somewhat bend the end cross sections of the profiled tubes which are to be fitted together if necessary in order to facilitate the introduction upon assembly. This region of the cross sections which is narrowed by the bending should, to be sure, be removed again after the completion of the assembly of the heat exchanger. The tube ends should therefore inserted deeper into the duct by the length which is thus affected. This region then extends freely into the inside of the duct and can be subsequently removed. The elements forming the central duct or manifold can be complete rings as well as sections of rings which, after assembly with the profiled tubes of the matrix, form a shell-like region of the duct. These shells are subsequently connected to each other along longitudinal seams, for example, by welding in order to produce the closed duct. Such a procedure permits simple testing and possible revision of the seams between the profiled tubes and the shell sections of the duct or manifold.

The invention can also be advantageously employed for a profiled tue matrix which is traversed obliquely by the hot gases. This would mean, for instance, that in the case of a substantially concentric angular twist $\alpha$ in accordance with FIG. 11, the base ends 10' would in each case be arranged with their longitudinal center lines in planes which, for instance, are at right angles to the longitudinal central plane 3. The profiled tubes, for instance $4_1$, would then have their long axes A in planes at an angle of inclination relative to the longitudinal center plane E due to the mutual angle of twist.

Although the invention has been described in conjunction with a heat exchanger having tubular ducts 1, $2_1$, the construction of the base of the tubes and the connection with the ducts is applicable to manifolds of planar shape or any other shape as well.

Additionally, the shape of the base ends 10 of the tubes has been shown as rectangular i.e. a four-sided polygon with interior right angles; other polygon shapes may be applicable. The sides of the rectangle need not be longer than the ends as shown but could be equal in which case the rectangle would be a square.

Although the invention has been described above in relation to specific embodiments thereof, it will become apparent to those skilled in the art that numerous modifications and variations can be made within the scope and spirit of the invention as defined in the attached claims.

What is claimed is:

1. A heat exchanger comprising an assembly of a plurality of heat exchanger tubes for conveying a first fluid therethrough which can undergo heat exchange with a second fluid flowing around the exterior of the tubes, said tubes including portions of oval cross-section arranged in spaced relation in rows and columns in which the tubes are staggered to internest with one another, distributor means connected to said assembly for supply of said first fluid to said tubes and for receiving said first fluid therefrom after said first fluid has undergone heat exchange with said second fluid, said distributor means comprising inlet and outlet ducts spaced from one another, each duct being constituted as a pipe including a plurality of abutting, longitudinal elements mounted on one another in sealed relation, said elements having abutting surfaces provided with recesses which register with one another and defined openings receiving said tubes, said tubes including base ends of polygonal cross-section engaged in said openings.

2. A heat exchanger as claimed in claim 1 wherein the polygonal cross-section of the base ends of the tube is rectangular.

3. A heat exchanger as claimed in claim 2 wherein the oval portion of each tube has a major axis and a minor axis, said oval portion having ends disposed along said major axis which project beyond the rectangular edges of the base end.

4. A heat exchanger as claimed in claim 2 wherein the tubes in each row are parallel to one another and from the same angle of inclination with respect to a transverse center plane of said distributor means, each tube having a common longitudinal center plane for the portion of oval cross-section and for said rectangular base end.

5. A heat exchanger as claimed in claim 2 wherein the tubes in each row are parallel to one another and form the same angle of inclination with respect to a transverse center plane of said distributor means, said base ends of said tubes being twisted concentrical around the center of the portions of oval cross-section by the same angle of twist.

6. A heat exchanger as claimed in claim 5 wherein the oval portion of each tube has a longitudinal center plane which is disposed along a diagonal of the rectangular cross-section of the base end of the tube.

7. A heat exchanger as claimed in claim 5 wherein said base ends each has a longitudinal center plane forming an angle with the longitudinal center plane of the oval portion of the tube, said distributor means securing said base ends of said tubes at an angle relative to a transverse center plane of said distributor means which is equal to the angle formed between the longitudinal center planes of the base ends and said oval portions.

8. A heat exchanger as claimed in claim 1 wherein said elements have further abutting surfaces which are flat and free of recesses.

9. A heat exchanger as claimed in claim 1 wherein said elements include projecting lips at said abutting surfaces to form outwardly open seams at said abutting surfaces.

10. A heat exchanger as claimed in claim 1 wherein one of the elements of each abutting pair thereof includes an inner rib for engaging the other element of the pair at the interior of the distributor means.

11. A heat exchanger as claimed in claim 2 wherein said distributor means comprises a plurality of superimposed units each including a central element having opposite abutment surfaces with recesses therein in which said base ends are received, and cover strips on said abutment surfaces covering said base ends, each said unit being an independent assembly of the central element, the cover strips and the heat exchanger tubes whose base ends are received in the recesses of the central element.

12. A heat exchanger as claimed in claim 2 wherein said distributor means comprises a plurality of spaced elements having planar surfaces defining spaces therebetween, said base ends of the tubes being disposed in said spaces in end to end abutment with one another.

13. A heat exchanger as claimed in claim 12 wherein said spaced elements which receive said base ends of the tubes have smooth outer surfaces which are in abutment with adjacent spaced elements receiving the base ends of the adjacent line of abutting tubes.

14. A heat exchanger as claimed in claim 13 wherein the base ends of the tubes in each line have a common plane passing through the longitudinal centers of the tubes, said common plane being parallel to said smooth outer surfaces and forming an angle relative to a transverse center plane of said distributor means, said base ends of said tubes being twisted through an angle relative to a longitudinal center plane passing through the oval portions of the tubes which is equal to the angle formed by said common plane passing through the base ends of the tubes and the transverse center plane of said distributor means.

15. A heat exchanger as claimed in claim 14 wherein each pair of spaced elements and the base ends of the tubes therebetween forms an independent assembly unit.

16. A heat exchanger as claimed in claim 13 wherein said spaced elements are integral with said distributor means and define slots for receiving said base ends of said tubes.

17. A heat exchanger as claimed in claim 5 wherein a common inclined plane passes through the centers of said heat exchanger tubes in successive rows and columns and the distance between the centers of adjacent tubes is equal to the length of said base end of a tube as measured along the longitudinal center plane thereof.

18. A heat exchanger as claimed in claim 1 wherein said tubes have spaced rectilinear portions secured to said pipes and a U-shaped bend region joined to said rectilinear portions.

19. A heat exchanger as claimed in claim 19 wherein said base ends of said tubes are rectangular having longer and shorter sides, the longer side of the ends of the tubes extending lengthwise of the pipes, said portions of the tubes of oval cross-section being arranged with the major axes thereof substantially parallel to said pipes.

* * * * *